US007125289B2

(12) United States Patent
Chen et al.

(10) Patent No.: US 7,125,289 B2
(45) Date of Patent: Oct. 24, 2006

(54) JACK

(75) Inventors: Chih-Tse Chen, Taoyuan Hsien (TW); Han-Cheng Hsu, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 11/129,398

(22) Filed: May 16, 2005

(65) Prior Publication Data

US 2005/0260894 A1 Nov. 24, 2005

(30) Foreign Application Priority Data

May 18, 2004 (TW) ..... 93113917 A

(51) Int. Cl.
*H01R 13/64* (2006.01)

(52) U.S. Cl. ..... 439/677

(58) Field of Classification Search ..... 439/676, 439/677, 680

See application file for complete search history.

(56) References Cited

U.S. PATENT DOCUMENTS 6,257,935 B1 * 7/2001 Zhang et al. ..... 439/680
6,350,156 B1 * 2/2002 Hasircoglu et al. ..... 439/676

* cited by examiner

*Primary Examiner*—James R. Harvey
(74) *Attorney, Agent, or Firm*—Birch, Stewart, Kolasch & Birch, LLP

(57) ABSTRACT

A foolproof jack includes a shell and at least one elastomer. The shell has at least one joining opening, and the joining opening corresponds to a first type plug. The elastomer sets in the joining opening, and stops a second type plug to plug in the joining opening. The second type plug is different from the first type plug. The elastomer has a body and at least one stop portion. The body is mounted in the shell. In a Y-direction, at least one arm outward extends from the body. In a Z-direction, a part of the arm is bent. In an X-direction, the stop portion extends inward from the arm.

21 Claims, 3 Drawing Sheets

JACK

BACKGROUND

The invention relates to a foolproof jack, and in particular, to a foolproof jack that can prevent incorrect type plug from inserting therein.

It is well recognized that the computer industry is experiencing tremendous growth, driven in large part by a demand for immediate access to information. To meet this demand, the industry has developed a wide assortment of electrical apparatus to transmit and receive electronically retrievable data.

Although there are numerous public and private networks and databases that provide electronically retrievable data, absent the ability to connect directly with a network, one is relegated to relying upon the exchange of discs or tapes in order to receive the data that is accessible through the network.

The ability to freely access data on a network and to transfer information between computers can dramatically increase productivity and reduce overall production time. Accordingly, computers have been equipped with means to access electronically retrievable data over networks, such as the Internet, a world wide network, local area networks ("LANs") and wide area networks ("WANs").

The transfer of data over a network can be accomplished with wireless technology or by telephone lines and cables. The interface between a computer and a cable or telephone line is typically accomplished through a media connector, such as a hub.

One conventional type of media connector is the Registered Jack connector (RJ-series connector), such as RJ-45 series connectors and RJ-11 series connectors. For example, the RJ-45 plug can electrically connect to a RJ-45 jack. Typically, RJ-45 connectors are typically used as an interface to connect electrical apparatus to LANs, particularly Ethernets. RJ-11 connectors are used as an interface to connect electrical apparatus to the Internet or for standard modem applications using normal telephone lines. In the computer, the RJ-45 jack and the RJ-11 jack are often disposed next to each other. It is noted that the appearance of the RJ-45 connector is similar to that of the RJ-11 connector, but the RJ-11 plug is slightly smaller than the RJ-45 plug.

Since the RJ-11 plug is slightly smaller than the RJ-45 plug, it may be erroneously inserted into the RJ-45 jack, thus damaging the electronic device with such RJ-11 plug.

Accordingly, what is called for is a RJ-45 jack that can securely accommodate the RJ-45 plug while prevent other plugs from insertion.

SUMMARY

In order to address the disadvantages of the aforementioned jack, an embodiment of the invention provides a foolproof jack that can prevent incorrect type plug from inserting therein, thus avoiding damage and interference.

An embodiment of the invention provides a foolproof jack comprising a shell and at least one foolproof structure. The shell comprises at least one joining opening corresponding to a first type plug. The foolproof structure is set in the joining opening to stop a second type plug to plug in the joining opening. The foolproof structure comprises a body and at least one stop portion. The body is connected to the shell, and comprises at least one arm outward extending in a Y-direction. A bending part of the arm is extended in a Z-direction. The stop portion extends from the bending part of the arm in an X-direction.

Furthermore, the foolproof structure further comprises a fixed portion located at an end of the arm. The fixed portion extends in a lateral or longitudinal orientation to the arm. The fixed portion or the body is connected to the shell by insertion, locking, adhesion, soldering, or contact.

It is noted that the second type plug does not press the arm but is stopped by the stop portion upon insertion into the joining opening. Also, when the first type plug is inserted into the joining opening, it presses the arm but is not stopped by the stop portion.

Moreover, the foolproof structure is selected from the group consisted of plastic and metal, and is U-shaped or L-shaped. The foolproof structure is an elastomer, or is provided with resilience. The first type plug is bigger than the second type plug. The stop portion is polygonal, or is provided with a curved or a sharp edge.

Additionally, the stop portion or the arm is moveable in the shell in the Y-direction. A distance between a sidewall of the arm and the shell is less than the width of the first type plug, or a distance between the arms is less than the width of the first type plug when the number of the arm is two. The stop portion inward extends from the bending part of the arm in the X-direction.

Thus, the correct plug can be easily inserted into the jack of the embodiment without interference, but the incorrect plug cannot be inserted therein. As a result, the electronic device with the plug of the embodiment is not interfered by other electronic devices, thus avoiding damage.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the subsequent detailed description and the accompanying drawings, which are given by way of illustration only, and thus are not limitative of the present invention, and wherein.

DETAILED DESCRIPTION

Figure 1:
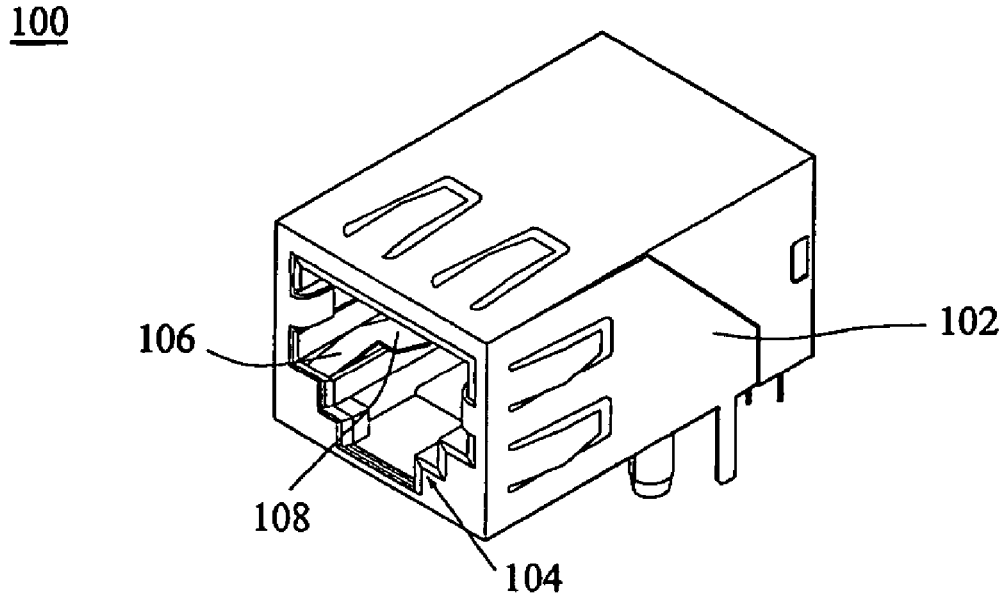
FIG. 1 is a schematic view of a jack as disclosed in an embodiment of the invention.
Figure 2:
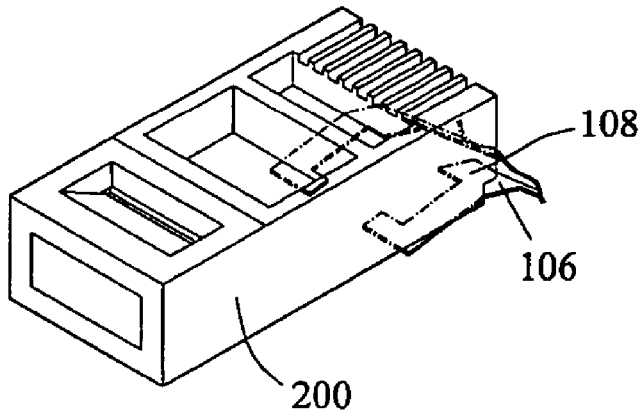
FIG. 2 is a partial schematic view of a RJ-45 plug inserted into the jack in FIG. 1.
Figure 3:
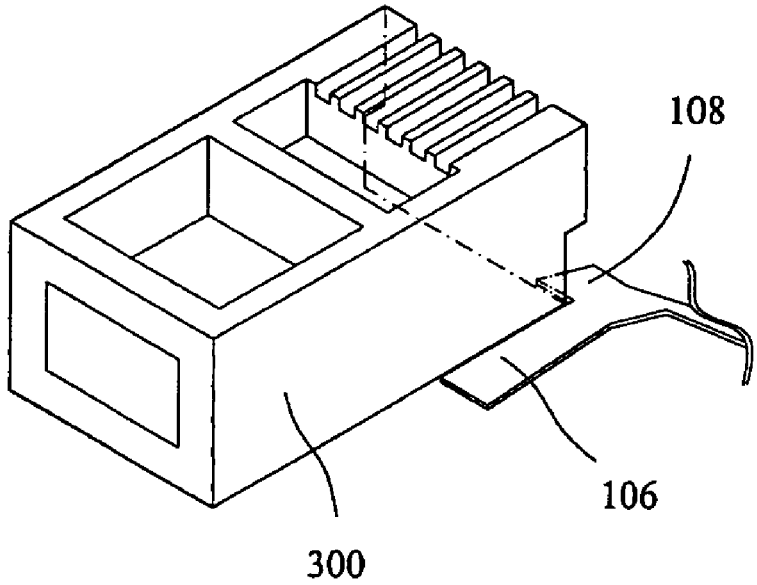
FIG. 3 is a partial schematic view of a RJ-11 plug inserted into the jack in FIG. 1.

FIG. 1 is a schematic view of a jack 100 as disclosed in an embodiment of the invention. FIG. 2 is a partial schematic view of a RJ-45 plug 200 inserted into the jack 100. FIG. 3 is a partial schematic view of a RJ-11 plug 300 inserted into the jack 100.

As shown in FIG. 1, the jack 100 comprises a shell 102 and a foolproof structure 106. The shell 102 comprises a joining opening 104 corresponding to a compatible (correct) plug received therein. For example, the correct plug may be RJ-45, RJ-12, RJ-11, or other type. Additionally, based on needs, the shell 102 may comprise terminals, a circuit board, or other electronic devices.

Figure 4:
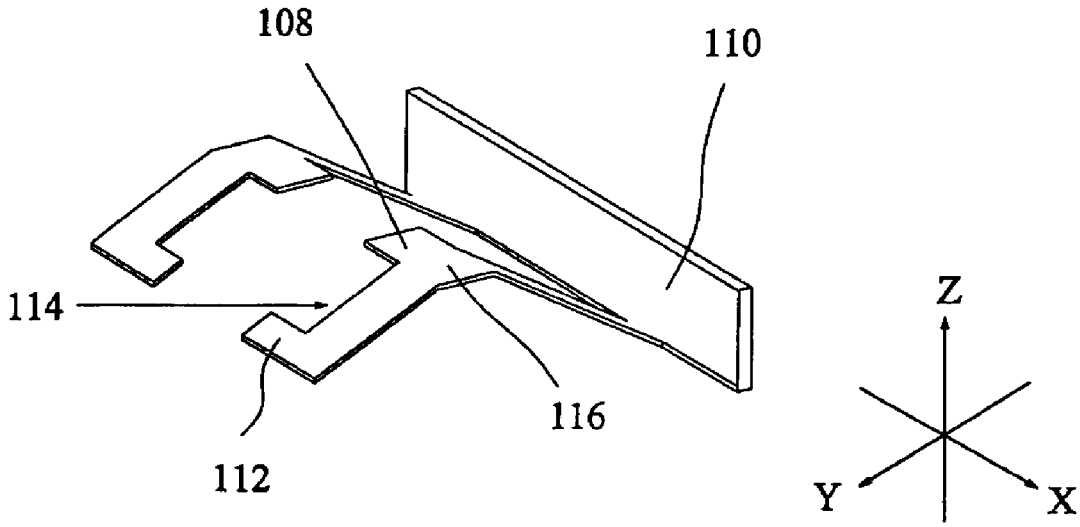
FIG. 4 is a schematic view of a foolproof structure as disclosed in an embodiment of the invention.

The foolproof structure 106 is set in the joining opening 104 to stop an incompatible (incorrect) plug to plug in the joining opening 104. The incorrect plug is smaller than the correct plug. For example, the incorrect plug may be RJ-11, RJ-12, RJ-45, or others. Referring to FIGS. 1 and 4, the foolproof structure 106 comprises a body 110 and a stop portion 108. For example, the foolproof structure 106 is provided with resilience, such as an elastomer. Additionally, the foolproof structure 106 may be made of plastic or metal, and is U-shaped or L-shaped.

The body 110 is connected to the inside of the shell 102, and comprises at least one arm 116 extending outward in a Y-direction. A bending part of the arm 116 is extended in a Z-direction. Furthermore, a distance between a sidewall of the arm 116 and the shell 102 is less than the width of the correct plug. Also, when the number of the arm 116 is two or more, a distance between the arms 116 is less than the width of the correct plug.

Figure 5:
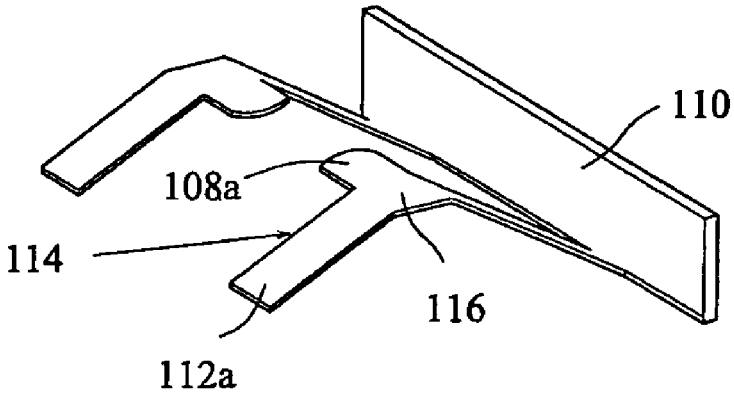
FIG. 5 is a schematic view of another foolproof structure as disclosed in an embodiment of the invention.
Figure 6:
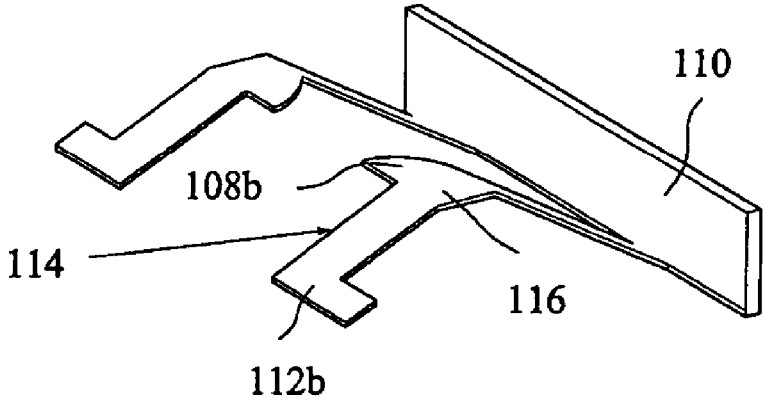
FIG. 6 is a schematic view of yet another foolproof structure as disclosed in an embodiment of the invention.

Additionally, the stop portion 108 is formed at the bent portion of the arm 116, and extends inward from the sidewall 114 of the arm 116 in an X-direction. The stop portion 108 is formed to prevent the incorrect plug from insertion into the jack 100. For example, the stop portion 108, 108*a*, 108*b* can be polygonal as shown in FIG. 4, or provided with a curved edge as shown in FIG. 5 or a sharp edge as shown in FIG. 6. The body 110 may be connected to the shell 102 by insertion, locking, adhesion, soldering, or contact.

Referring to FIG. 4, the foolproof structure 106 further comprises a fixed portion 112 located at an end of the arm 116. The fixed portion 112 serves to fix the foolproof structure 106 in the shell 102. Alternatively, when the body 110 is fixed in the shell 102, the fixed portion 112 may be slidable in the shell 102. As long as the fixed portion 112, 112*a*, 112*b* corresponds to the shell 102, it may extend inward in a lateral orientation to the arm 116 as shown in FIG. 4, extend in a longitudinal orientation to the arm 116 as shown in FIG. 5, or extend outward in a lateral orientation to the arm 116 as shown in FIG. 6. Connection between the fixed portion 112 and the shell 102 depends upon connection between the body 110 and the shell 102 as long as the foolproof structure 106 is moveable in the shell 102 in the Y-direction. For example, the fixed portion 112 can be connected to the shell 102 by insertion, locking, adhesion, soldering, or contact.

Referring to FIGS. 1–4, the following example is described based on a RJ-45 jack using the foolproof structure 106. In such example, the foolproof structure 106 is fixed in the shell 102 via the fixed potion 112. When a RJ-45 plug 200 is inserted into the joining opening 104 of the shell 102, it presses the arm 116 of the foolproof structure 106 so that the foolproof structure 106 is moved toward the inside of the shell 102 in a Y-direction while the stop portion 108 is moved downward. When insertion of the RJ-45 plug 200 continues, it is not stopped by the stop portion 108 since the stop portion 108 is moved to the side of the RJ-45 plug 200 along with the arm 116. As a result, the RJ-45 plug 200 is assembled in the jack 100

When a RJ-11 plug 300, smaller than the RJ-45 plug 200, is incautiously inserted into the joining opening 104 of the shell 102, it does not press the arm 116 of the foolproof structure 106 since the width of the RJ-11 plug 300 is less than the distance between the adjacent arms 116. During the insertion of the RJ-11 plug 300, it is stopped by the stop portion 108 as its front end contacts the stop portion 108. As a result, the RJ-11 plug 300 cannot be inserted into the jack 100.

Thus, in an embodiment of the invention, the correct plug can be easily inserted into the jack without interference, but the incorrect plug cannot. As a result, the electronic device with the plug of the embodiment may avoid interference from other electronic devices, with no resulting damage.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A jack comprising:

a shell comprising at least one joining opening corresponding to a first type plug; and at least one elastomer set in the joining opening to stop a second type plug to plug in the joining opening, wherein the second type plug is different from and smaller than the first type plug, wherein the elastomer comprises:

a body, mounted in the shell, comprising at least one arm extending outward in a Y-direction, wherein a bending part of the arm is extended in a Z-direction, and at least one stop portion extending inward from the bending part of the arm in a X-direction.

2. A jack comprising:

a shell comprising at least one joining opening corresponding to a first type plug; and at least one foolproof structure set in the joining opening to stop a second type plug to plug in the joining opening, wherein the second type plug is different from the first type plug, and wherein the foolproof structure comprises:

a body, mounted in the shell, comprising at least one arm extending outward in a first direction, wherein a bending part of the arm is extended in a second direction, and at least one stop portion extending from the bending part of the arm in a third direction.

3. The jack as claimed in claim 2, wherein the foolproof structure further comprises a fixed portion located at an end of the arm.

4. The jack as claimed in claim 3, wherein the fixed portion extends in a lateral orientation to the arm.

5. The jack as claimed in claim 3, wherein the fixed portion extends in a longitudinal orientation to the arm.

6. The jack as claimed in claim 3, wherein the fixed portion is mounted in the shell by at least one of insertion, locking, adhesion, soldering, and contact.

7. The jack as claimed in claim 2, wherein the second type plug does not press the arm but is stopped by the stop portion when the second type plug is inserted into the joining opening.

8. The jack as claimed in claim 2, wherein the first type plug presses the arm but is not stopped by the stop portion when the first type plug is inserted into the joining opening.

9. The jack as claimed in claim 2, wherein the foolproof structure is provided with resilience.

10. The jack as claimed in claim 2, wherein the foolproof structure is plastic or metal.

11. The jack as claimed in claim 2, wherein the first type plug is RJ-11, RJ-12, or RJ-45.

12. The jack as claimed in claim 2, wherein the first type plug is larger than the second type plug.

13. The jack as claimed in claim 2, wherein the foolproof structure is U-shaped or L-shaped.

14. The jack as claimed in claim 2, wherein the stop portion is polygonal, or provided with a curved edge or a sharp edge.

15. The jack as claimed in claim 2, wherein the foolproof structure is moveable in the shell in the first direction.

16. The jack as claimed in claim 2, wherein the arm is moveable in the shell in the first direction.

17. The jack as claimed in claim 2, wherein the body is connected to the shell by at least one of insertion, locking, adhesion, soldering, and contact.

18. The jack as claimed in claim 2, wherein a distance between a sidewall of the arm and the shell is less than the width of the first type plug.

19. The jack as claimed in claim 2, wherein the second type plug is RJ-11, RJ-12, or RJ-45.

20. The jack as claimed in claim 2, wherein the stop portion extends inwardly from the arm in the third direction.

21. The jack as claimed in claim 2, wherein, when the number of arms is two or more, the distance between the arms being less than the width of the first type plug.

* * * * *